United States Patent [19]

Börngen

[11] Patent Number: 5,016,533

[45] Date of Patent: May 21, 1991

[54] BOMBLET PROJECTILE INCLUDING A STABILIZATION BAND

[75] Inventor: Lutz Börngen, Köln, Fed. Rep. of Germany

[73] Assignee: Rheinmetall GmbH, Düsseldorf, Fed. Rep. of Germany

[21] Appl. No.: 555,348

[22] Filed: Jul. 18, 1990

[30] Foreign Application Priority Data

Jul. 19, 1989 [DE] Fed. Rep. of Germany ..... 3923885

[51] Int. Cl.[5] ..... F42B 12/58

[52] U.S. Cl. ..... 102/386; 102/387; 102/388; 102/393; 102/489; 244/138 R; 244/145

[58] Field of Search ..... 102/386, 387, 388, 393, 102/489, 339, 348, 359, 337, 338, 354, 225, 226, 227; 244/145, 142, 138 R

[56] References Cited

U.S. PATENT DOCUMENTS

| | | | |
|---|---|---|---|
| 1,319,553 | 10/1919 | Ziegenfuss | 102/337 |
| 3,104,856 | 9/1963 | Knacke et al. | 244/145 |
| 3,521,841 | 7/1970 | Finney et al. | 244/145 |
| 3,596,856 | 8/1973 | Drew | 244/145 |
| 4,418,624 | 12/1983 | Willi et al. | 102/386 |
| 4,488,488 | 12/1984 | Looger et al. | 102/387 |
| 4,565,341 | 1/1986 | Zacharin | 244/138 R |
| 4,653,401 | 3/1987 | Gatti | 102/489 |
| 4,715,282 | 12/1987 | Rosenberg et al. | 102/393 |
| 4,777,879 | 10/1988 | Bueno et al. | 102/393 |
| 4,958,566 | 9/1990 | Siebrand et al. | 102/386 |

FOREIGN PATENT DOCUMENTS 3506226 8/1986 Fed. Rep. of Germany .

*Primary Examiner*—David H. Brown
*Attorney, Agent, or Firm*—Spencer & Frank

[57] ABSTRACT

A bomblet projectile includes a projectile body, a fuse housing on the body at the rear end thereof; and an unwindable stabilization band for stabilizing the position of the projectile while dropping. The band forms, in the deployed state, a loop having leg portions terminating in fastening regions secured to the fuse housing and a dome portion flanked by the leg portions. The band has a length and different widths along the length. The band has its greatest width in the dome portion and its smallest width in the leg portions, externally of the fastening regions.

13 Claims, 10 Drawing Sheets

BOMBLET PROJECTILE INCLUDING A STABILIZATION BAND

CROSS REFERENCE TO RELATED APPLICATION

This application claims the priority of Federal Republic of Germany Application Serial No. P 39 23 885.7 filed July 19, 1989, which is incorporated herein by reference.

BACKGROUND OF THE INVENTION

The present invention relates to a bomblet projectile having an unwindable stabilization band arrangement fastened to the rear of the projectile for stabilizing the flight position of the projectile while falling.

Such a bomblet projectile is disclosed, for example, in German Offenlegungsschrift 3,506,226. The stabilization band arrangement disclosed therein may be a single stabilization band in the form of a simple loop, or it may include perpendicularly crossing stabilization band loops. In either case the band or bands are wound up and their ends fastened to the fuse housing of the bomblet projectile. Each band has a constant width over its entire length. It is a drawback of this arrangement that when the projectile is deployed and the band unwinds, it is able to effect only a slight deceleration of the fall of the projectile and a slight stabilization of the flight position (attitude) since, in its forward region adjacent the fuse housing, the band is exposed to a considerable air stream which presses the band inwardly, preventing it from properly unfolding (opening) which causes it to flutter and possibly interfere with the detonating and activating mechanism which must be enabled during the falling phase.

Prior art stabilization bands of uniform width therefore do not provide good stabilization of the projectile's position. The fluttering of the band has the result that the decelerating (pull-back) force is not constant and undesirable transverse forces are generated. Consequently, the flight behavior of the bomblet is unsatisfactory.

Submunition of artillery projectiles, such as bomblets, must be decelerated and stabilized after deployment (ejection) in order to realize the desired effect in the target. The bomblets should hit the target perpendicularly with their shaped charge cone pointed downward. The more the flight position of the bomblet is inclined to the vertical at the point of impact, the greater is the chance of it failing to detonate.

SUMMARY OF THE INVENTION

It is an object of the present invention to provide a bomblet projectile which exhibits an improved flight stability.

This object and others to become apparent as the specification progresses, are accomplished by the invention, according to which, briefly stated, the bomblet projectile includes a projectile body, a fuse housing on the body at the rear end thereof; and an unwindable stabilization band for stabilizing the position of the projectile while dropping. The band forms, in the deployed state, a loop having leg portions terminating in fastening regions secured to the fuse housing and a dome portion flanked by the leg portions. The band has a length and different widths along the length. The band has its greatest width in the dome portion and its smallest width in the leg portions, externally of the fastening regions.

By providing the stabilization band or bands with a narrow width in the vicinity of the attachment to the fuse housing where air enters behind the fuse housing, an inward deformation (pressing) of the band or bands by the air flow is advantageously prevented. The dome portion of the band loop is better exposed to the air flow and, as a result, the band is able to "unfold" (open) better and produce a significantly improved deceleration and attitude stabilization of the falling bomblet projectile. As a result, an improved impact and ignition and a better effect in the target are obtained.

DESCRIPTION OF THE PREFERRED EMBODIMENTS

Figure 1A:
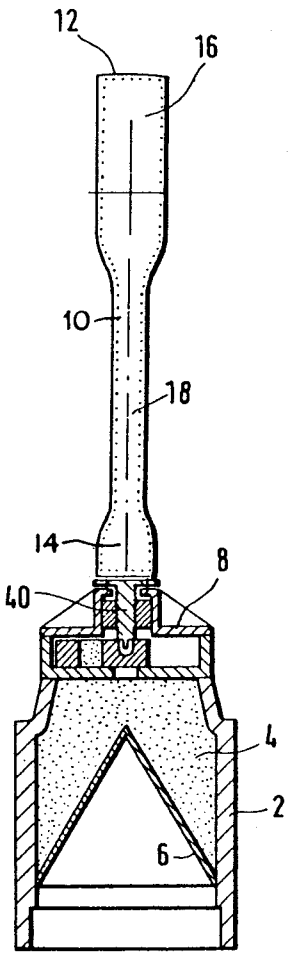
FIG. 1*a* is a view similar to FIG. 1, as seen in the direction of arrow A of FIG. 1.
Figure 1:
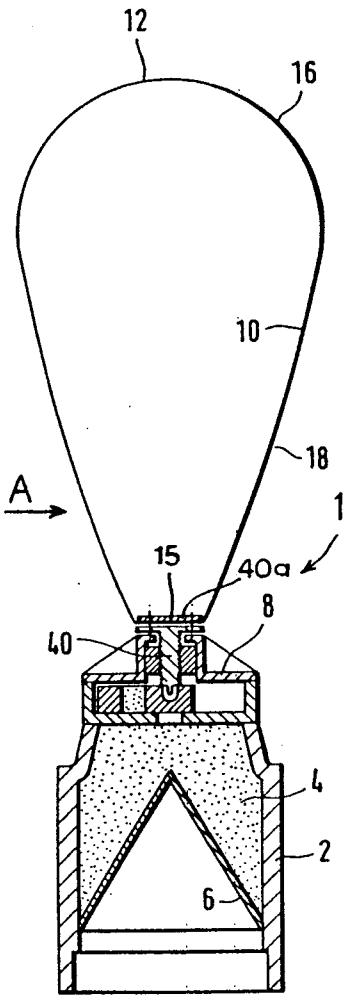
FIG. 1 is a longitudinal sectional view of a bomblet projectile including a side view of a simple stabilization band loop according an embodiment of the invention.

Referring to FIGS. 1 and 1*a*, the bomblet projectile 1 includes a projectile body 2 containing an explosive charge 4, as well as a shaped charge liner 6. On the rear of the bomblet projectile body 2 a fuse housing 8 is provided for an impact fuse. To allow a large-caliber carrier projectile to accommodate several bomblet projectiles in a space-saving nesting stack, the fuse housing 8 has a slightly smaller diameter than the bomblet projectile body 2. In order to stabilize the flight position of the falling bomblet projectile 1, a strip-shaped unwindable stabilization band 10 is fastened to the rear of the fuse housing 8. For fastening to the fuse housing 8, a plate 15 clamps widened end portions 14 of the band 10 in an overlapping relationship to a head 40*a* of a firing pin body 40 which, in turn, is held in the fuse housing 8.

Thus, as shown in FIGS. 1 and 1*a*, the deployed band 10 is loop-shaped and has relatively narrow leg portions 18 (which terminate in respective widened end portions 14) and a wide central or dome portion 12 formed of a band length 16. In order to realize a good deceleration effect and good attitude stabilization, the band length 16 has a width of about twice the width of the narrow leg portions 18. In some cases it may also be of advantage for the band length 16 to be at least three times as wide as the leg portions 18.

Figure 2:
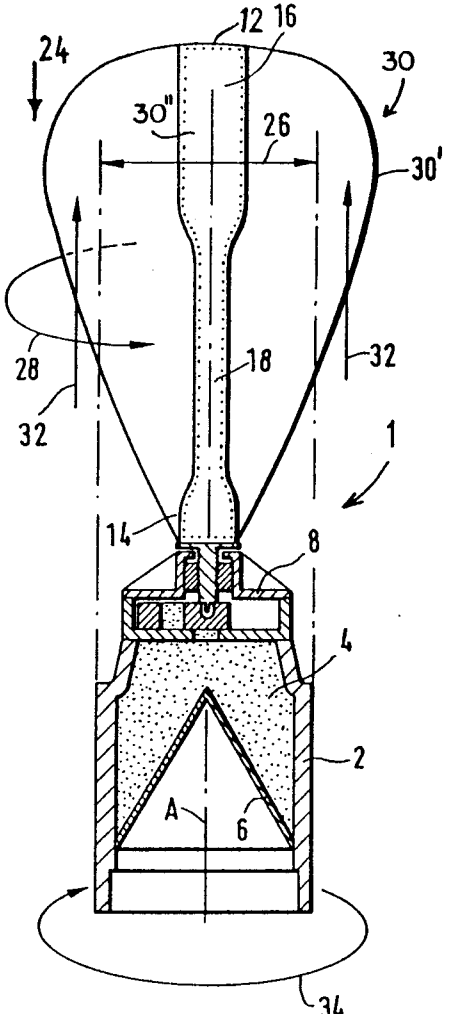
FIG. 2 is a longitudinal sectional view of a bomblet projectile including a crossed stabilization band loop arrangement according to another embodiment of the invention.

In FIG. 2, the stabilization band arrangement is a crossover arrangement 30 composed of two long strip-shaped stabilization bands 30′ and 30″ (each being similar to the band 10 of FIGS. 1 and 1*a*) which cross over one another in the dome region 12 of the arrangement; they both have narrow regions (leg portions) 18 and a broadened band length 16.

In use, the bomblet projectile 1 has a direction of flight indicated by the arrow 24. The direction of rotation of the bomblet projectile (imparted by the spinning of the carrier projectile at a rate of, for example, up to 12,000 rpm) is indicated by an arrow 34. Thus, there results a component of the relative air velocity which attacks the crossover stabilization band arrangement 30 in the direction of an arrow 28, that is, in the circumferential direction, and a component which attacks it axially in the direction of an arrow 32 (along the center axis A of the bomblet projectile 1). Due to the inventive configuration of stabilization bands with nonuniform widths, the narrow regions 18 near the rear of the projectile body are not pushed "inwardly" (radially inwardly with respect to the axis A). Rather, the air is able to easily flow from below inwardly past the narrow regions 18 and axially against the underside of the broadened regions 16 in the dome region 12 so that these broadened regions very advantageously widen radially outwardly with respect to the axis A, as shown by an arrow 26, and develop a strong decelerating effect on the falling bomblet projectile 1. This stabilizes the attitude of the projectile in an effective manner.

Figure 3:
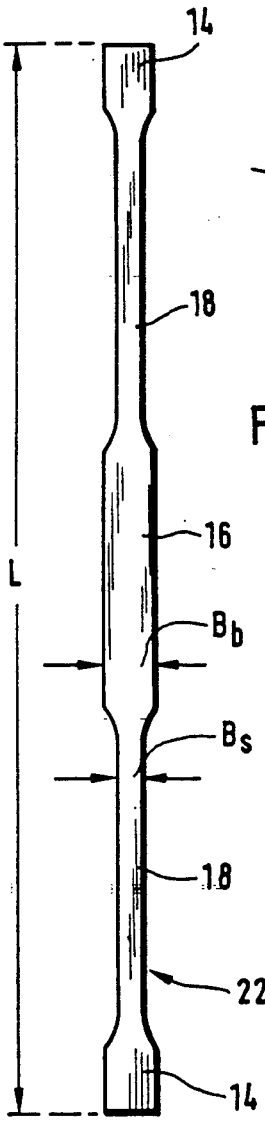
FIG. 3 is a plan view of an unattached stabilization band according to one embodiment of the invention.

FIG. 3 shows an individual stretched out stabilization band or band strip 22 having a wide central length portion 16 and narrow leg portions 18. This band also has fastening regions 14 at the ends which, in use, are superposed and are fastened to the fuse housing in a manner described in connection with FIG. 1.

The total length L of the band 22 is about 300 mm and the length of the broadened region 16 lies between 60 and 120 mm (preferably about 80 mm). The width $B_b$ of the broadened region 16 is 12 mm, while the width $B_S$ of each narrow region 18 is only 6 mm.

Figure 3A:
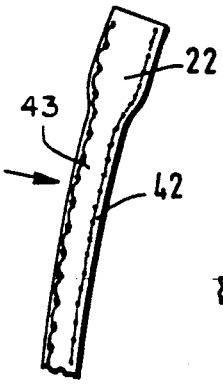
FIG. 3*a* is a plan view of a portion of an unattached stabilization band according to another embodiment of the invention.

A large area of attack is desirable for the circumferential component of the air flow indicated by the arrow 28, in order to exert a greater torque on the unscrewable firing pin body 40. To obtain such a large area of attack, the band or bands 22 are, when the bomblet projectile 1 is falling, oriented obliquely to the circumferentially directed air flow component 28, which is essentially transverse to the longitudinal axis A of the projectile. Such an oblique orientation may be achieved by appropriately shaping the bands 22 and connecting them with one another, or, as shown in FIG. 3*a*, by providing tightly stitched seams 42 longitudinally along one side edge and loosely stitched seams 43 on the other longitudinal side.

Figure 4:
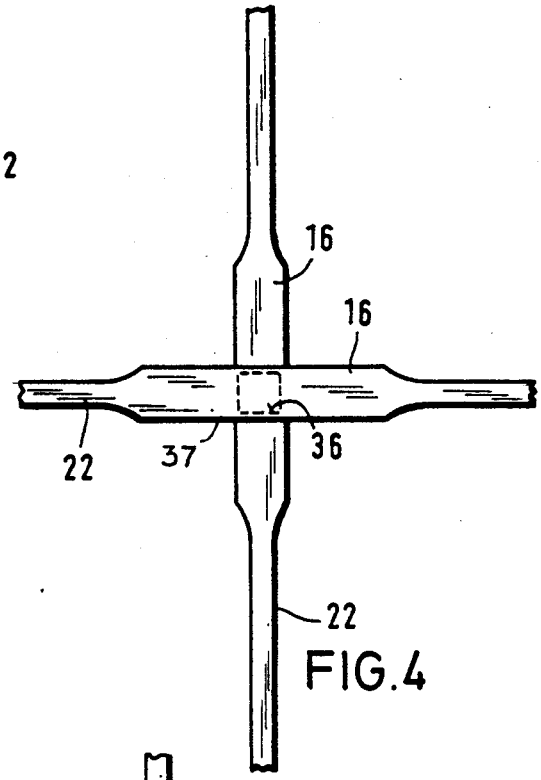
FIG. 4 is plan view of a portion of two unattached crossed stabilization bands according to a further embodiment of the invention.

FIG. 4 is a plan view of the broadened regions 16 of a crossover stabilization band arrangement. In the region 37 of crossover in the broadened regions 16 (as well as in the overlapping fastening regions 14 at the fuse housing), the bands 22 are firmly sewn and/or glued to one another as indicated schematically by a rectangular seam 36.

Figure 5:
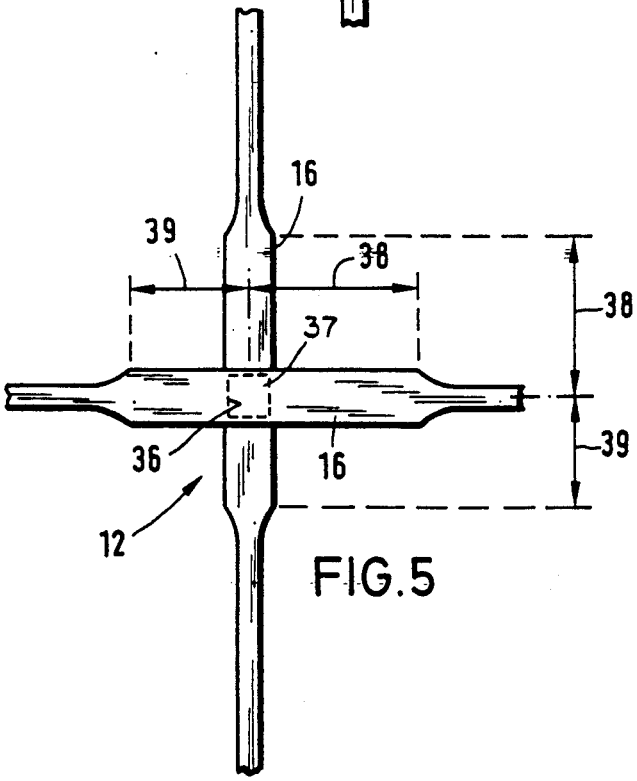
FIG. 5 is plan view of a portion of two unattached crossed stabilization bands according to still another embodiment of the invention.

Also, to influence the torque acting on the unscrewable firing pin body 40 it may be of advantage for each of the widened band lengths 16 to be longer on one side than on the other. FIG. 5 is a partial view of the dome region 12 of a crossover stabilization band with this feature. Both bands have the same lengths measured from the crossover region 37 to the oppositely disposed fastening regions (not shown in the drawing). Thus, in this embodiment, the length 38 of broadened region 16 on one side of the crossover region 37 is, for example, 50 mm and the length 39 on the other side is, for example, 35 mm.

Figure 6:
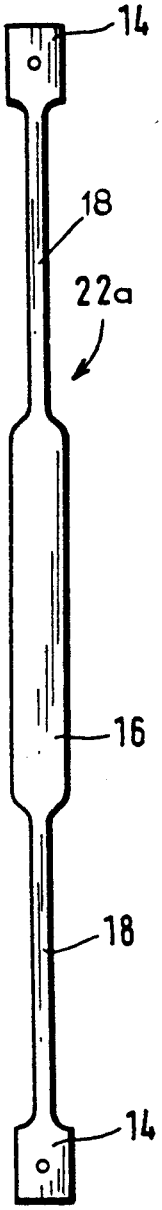
FIGS. 6, 6*a* and 6*b* are, respectively, a stretched out plan view, a side view and a bottom view of a stabilization band according to a still further embodiment of the invention.
Figure 6A:
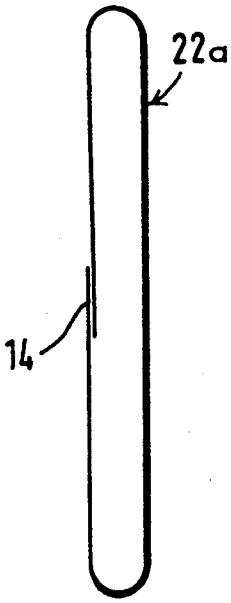
Figure 6B:
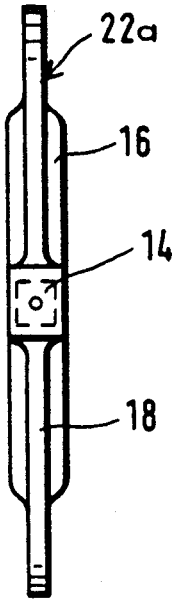
Figure 11:
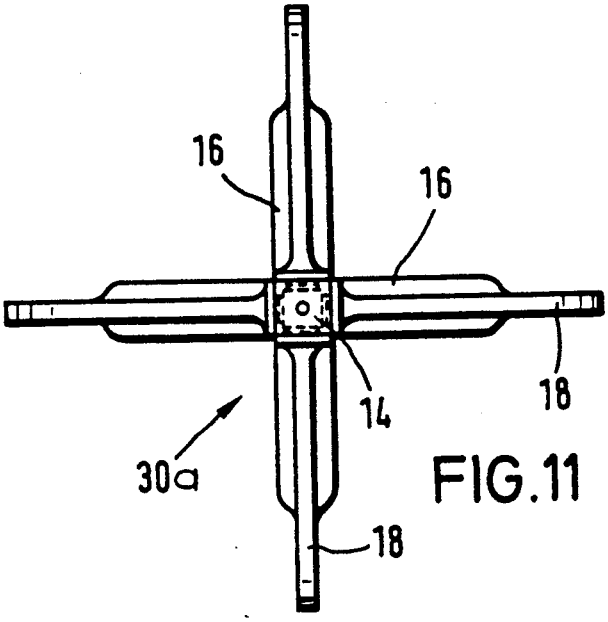
FIGS. 11 and 11*a* are, respectively, a bottom view and a side elevational view of two crossed stabilization bands according to still another embodiment of the invention.
Figure 11A:
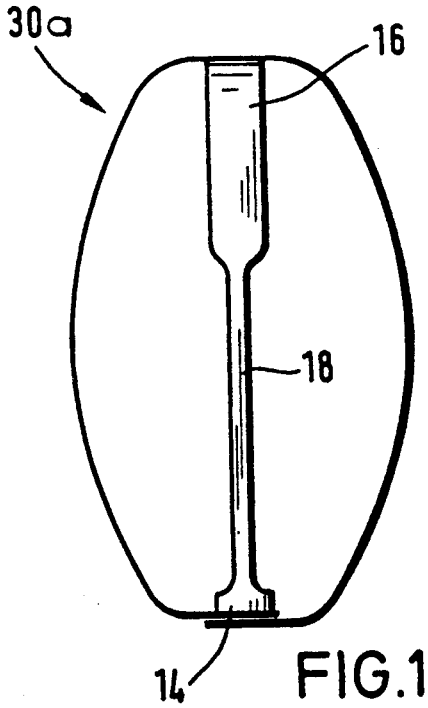

FIG. 6 is a stretched out plan view of an elongate band strip 22*a* having fastening regions 14 at opposite ends, a centered broadened region 16 and narrow regions 18 between the broadened region 16 and the respective fastening regions 14. FIG. 6*a* is a side view and FIG. 6*b* is a bottom view of the band strip 22*a* in a folded condition. In this embodiment, the broadened region 16 has a width of about three times the width of each narrow region 18. A corresponding embodiment in the form of a crossover stabilization band arrangement 30*a* formed of two bands of the structure shown in FIG. 6 is illustrated in FIGS. 11 and 11*a*.

Figure 10:
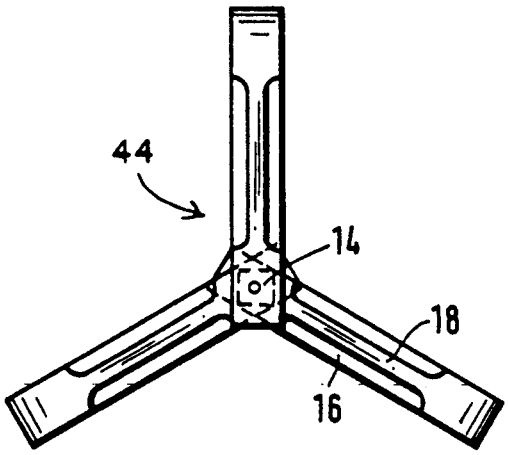
FIGS. 10 and 10*a* are, respectively, a bottom view and a side elevational view of a stabilization band arrangement according to another embodiment of the invention.
Figure 10B:
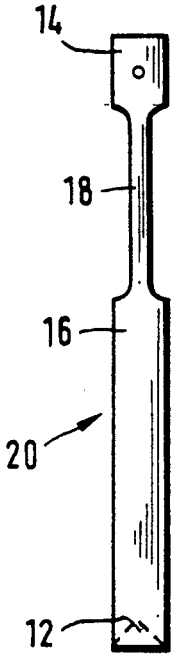
FIG. 10*b* is a stretched out plan view of a single stabilization band of the arrangement of FIGS. 10 and 10*a*.
Figure 10A:
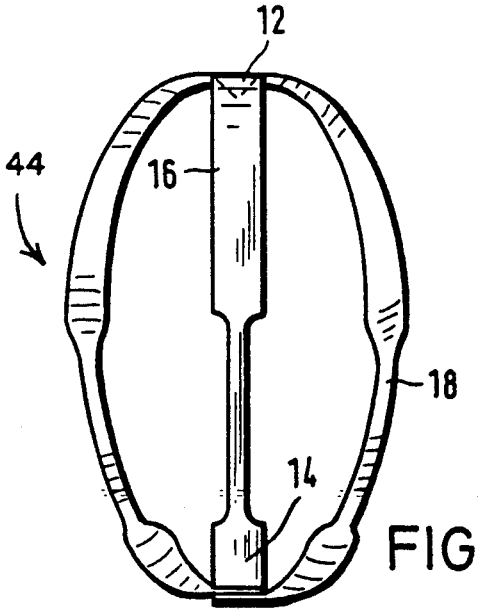

In special cases, it may be of advantage for the stabilization band arrangement to be composed of at least three individual, short (half-length) band strips extending from a fastening region at one end to a broadened region at the other end. Referring to FIGS. 10, 10*a*, and 10*b*, three bands 20 of a band arrangement 44 have respective fastening regions 14 fixed to the fuse housing 8, and the oppositely disposed broadened regions 16 are fastened (sewn or glued) together in the dome region 12.

Figure 9:
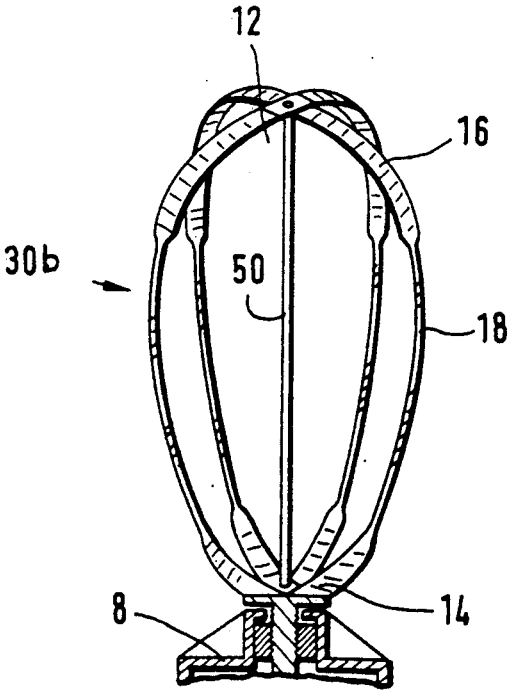
FIG. 9 is a side elevational view, partially in section, of a further variation of a stabilization band arrangement according to the invention, having a central traction element.

FIG. 9 shows that, in order to provide a greater bulging effect for the crossover stabilization band arrangement 30*b*, between the crossover portions of the broadened regions 16 and the overlapping portions of the fastening regions 14, a separate traction element 50, such as a cord or wire may be provided. The traction element 50 is slightly smaller than one-half the length L of a full length stabilization band strip 22 such as is illustrated in FIG. 3.

The embodiment of FIG. 9 may be of particular interest if it includes special means in the dome region 12 which broaden and/or reinforce the wide region 16 in order to increase the deceleration effect of the stabilization band. Such special means are applicable to both single and multiple stabilization band embodiments, and are illustrated in FIGS. 7, 7*a*, 7*b*, 8, 8*a*, 8*b*, 13, 13*a*, 13*b*, 14, 14*a*, 14*b*, 15, 15*a* and 15*b*. The traction force of the attacking air is transferred almost exclusively by the traction element 50 so that the band strips are able to further spread out radially in the dome region 12 due to the reduced traction force acting on them and will be able to produce a greater deceleration effect.

Figure 7B:
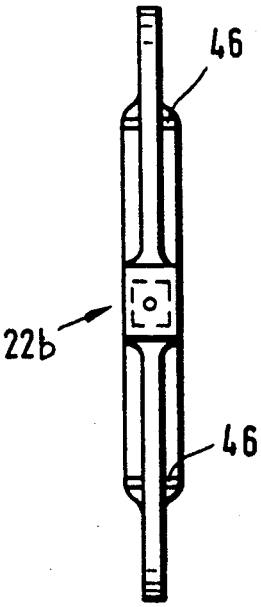
FIGS. 7, 7*a* and 7*b* are, respectively, a stretched out plan view, a side view and a bottom view of a stabilization band according to another embodiment of the invention.
Figure 7A:
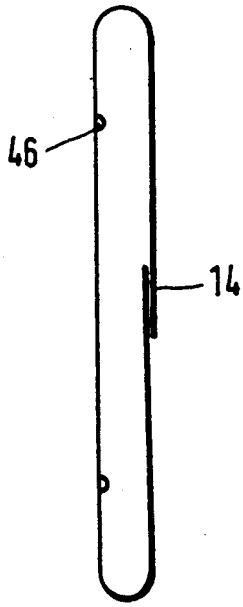
Figure 7:
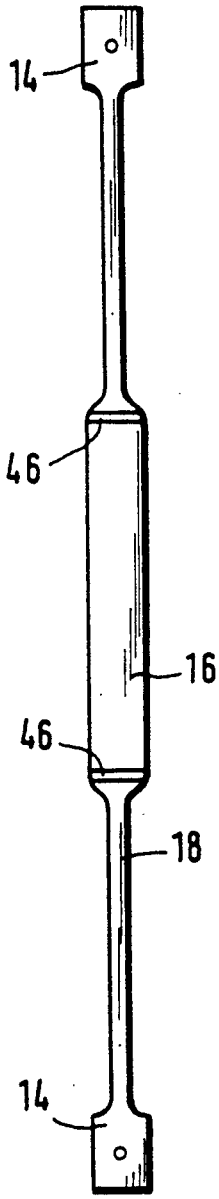

One such means for broadening and/or reinforcing the broadened region 16 is illustrated in FIGS. 7, 7*a* and 7*b*. The stabilization band 22*b* has weights 46 fastened (sewn and/or glued) thereto on the exterior faces of its broadened region 16 in direct proximity to the narrow regions 18. These weights may be, for example, pieces of lead wire each having a weight of about 2 grams.

Figure 8:
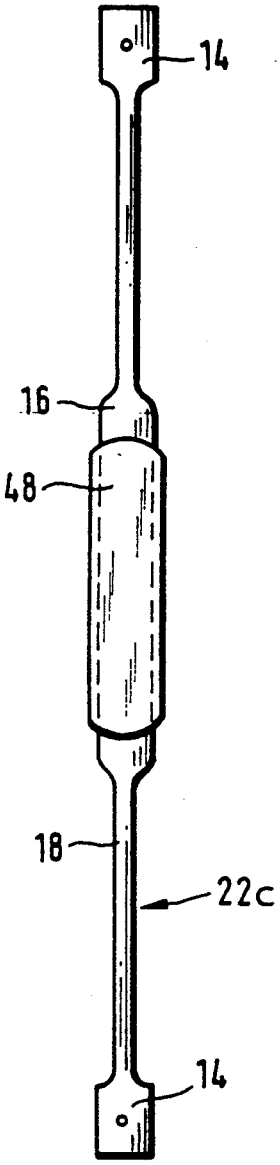
FIGS. 8, 8*a* and 8*b* are, respectively, a stretched out plan view, a side view and a bottom view of a stabilization band according to a further embodiment of the invention.
Figure 8A:
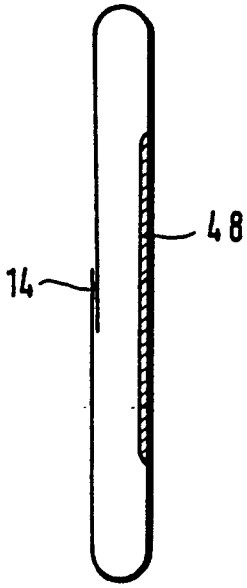
Figure 8B:
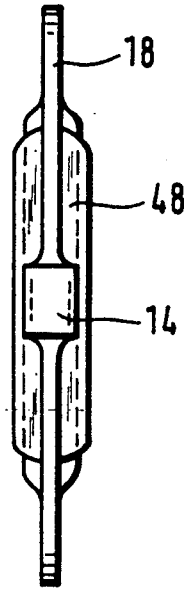

Another example of such a means is illustrated in FIGS. 8, 8*a* and 8*b* wherein a band strip 22*c* has a reinforcing insert 48 in its broadened region 16. The insert 48 may be sewn on and/or glued on. It is intended in use to spread out the reinforced broadened region 16 as flat and as broad as possible, so as to present a larger surface of attack for the radially inwardly and axially moving component of the air flow. Advisably, the insert 48 is broader than the region 16. The insert 48 may be composed, for example, of a thin sheet of plastic or spring steel.

Figure 13:
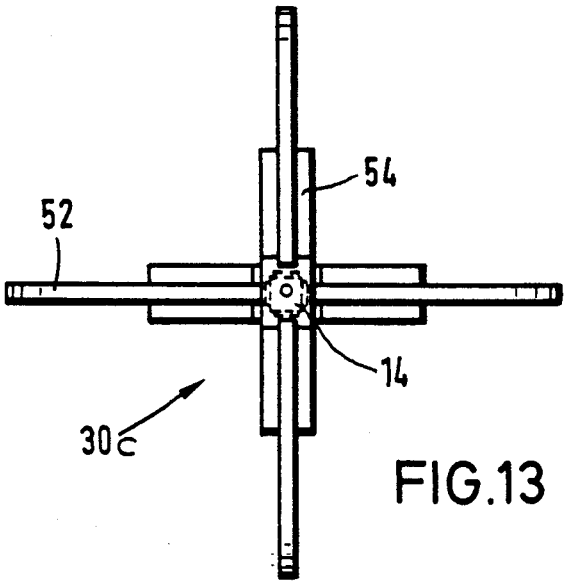
FIGS. 13 and 13*a* are, respectively, a bottom view and a side elevational view of two crossed stabilization bands according to a still further embodiment of the invention.
Figure 13B:
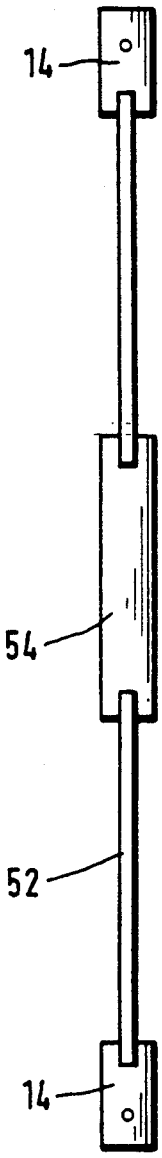
FIG. 13*b* is a stretched out plan view of a single stabilization band of the arrangement of FIGS. 13 and 13*a*.
Figure 13A:
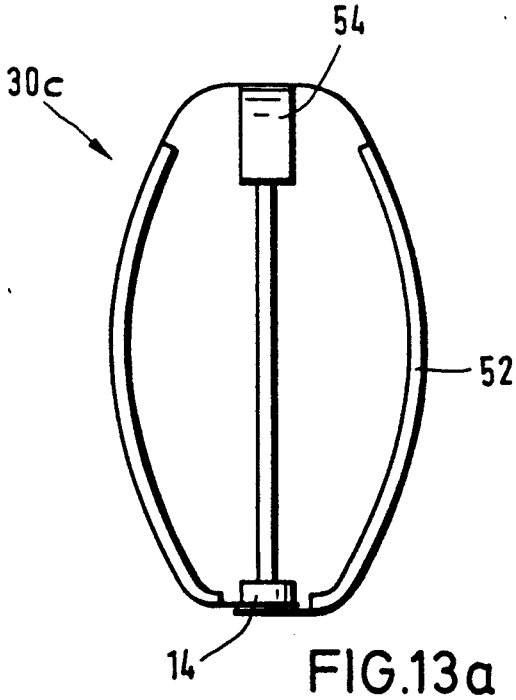

A further example of such a means is illustrated in FIGS. 13, 13*a* and 13*b*. In a crossover stabilization band arrangement 30*c*, the narrow region (leg portion) of each individual band is realized by a high tensile strength string or cord 52 and the broadened region is formed of flat, rectangular strips 54 made, for example, of thin sheets of plastic or spring steel. The mutual fastening may be effected by gluing and/or sewing.

Figure 14:
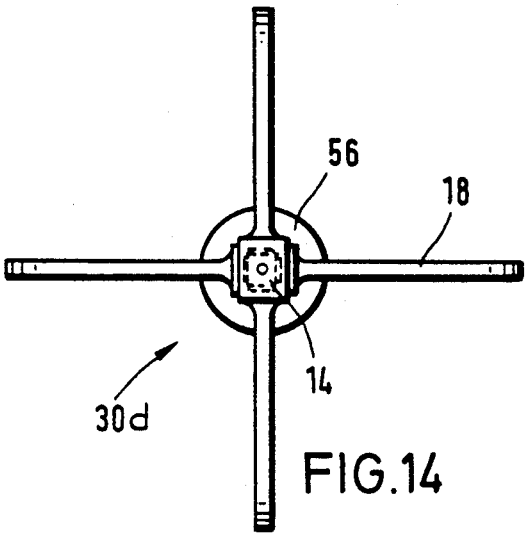
FIGS. 14 and 14*a* are, respectively, a bottom view and a side elevational view of two crossed stabilization bands according to another embodiment of the invention.
Figure 14B:
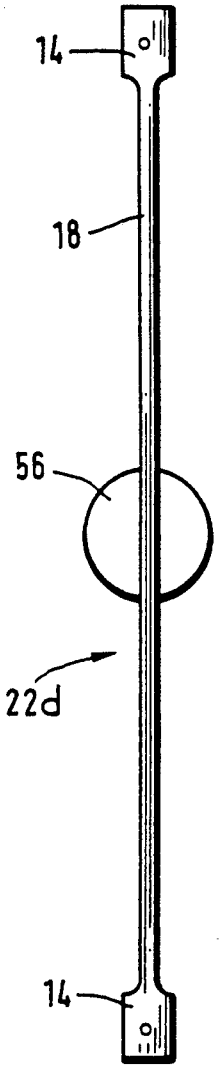
FIG. 14*b* is a stretched out plan view of a single stabilization band of the arrangement of FIGS. 14 and 14*a*.
Figure 14A:
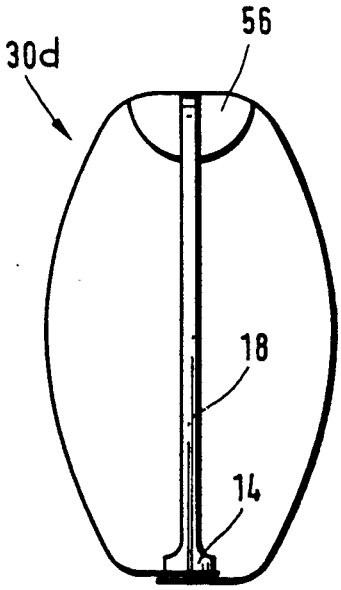

A still further example of such a means which broadens and/or reinforces the broadened region 16 is illustrated in FIGS. 14, 14*a* and 14*b*. In this embodiment the bands 22*d* of a crossover stabilization band arrangement 30*d* have a constant narrow width (equal to that of the narrow regions 18) from one fastening region 14 to the other. In order to broaden the region encompassing the crossover portion of the bands 22*d*, a flat disc 56 having a diameter of, for example, 35 mm is fastened there. The disc 56 also may be rectangular or square and may be composed, for example, of cardboard, plastic or a thin but bending resistant, elastic metal foil or spring steel sheet. The bands may be fastened to each other and to the fuse housing, as described above with respect to the other embodiments.

Figure 15:
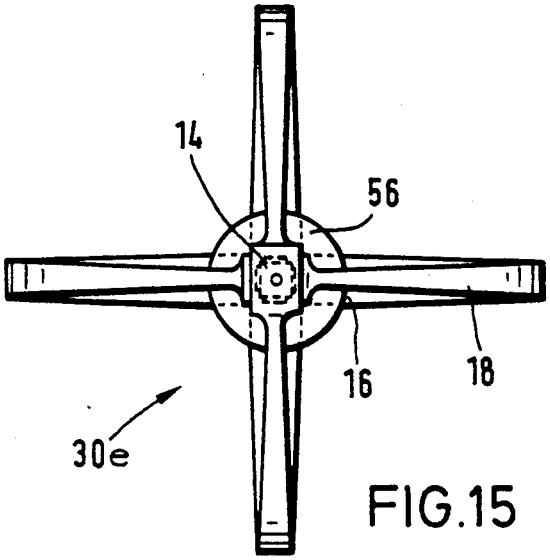
FIGS. 15 and 15*a* are, respectively, a bottom view and a side elevational view of two crossed stabilization bands according to still another embodiment of the invention.
Figure 15B:
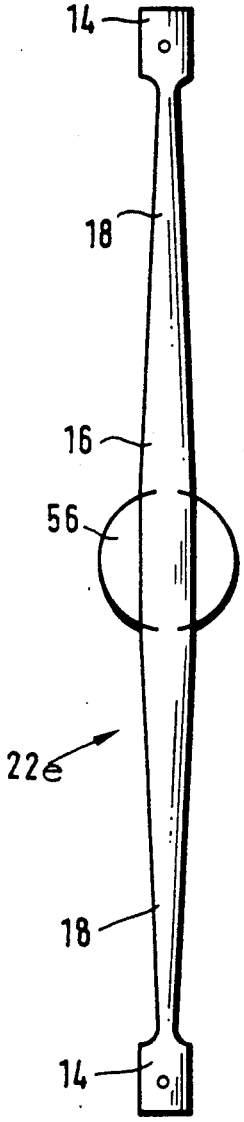
FIG. 15*b* is a stretched out plan view of a single stabilization band of the arrangement of FIGS. 15 and 15*a*.
Figure 15A:
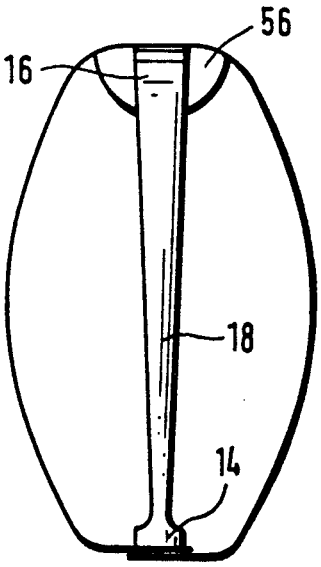

The embodiment of the crossover stabilization band arrangement 30*e* of FIGS. 15, 15*a* and 15*b* differs from that of FIGS. 14, 14*a* and 14*b* essentially in that there are linear transitions, rather than sudden transitions, between the narrow regions 18 and the broadened regions 16. For this purpose, each band 22*e* has slightly oblique outer edges and a width which continuously increases to become the broadened region 16.

Figure 12:
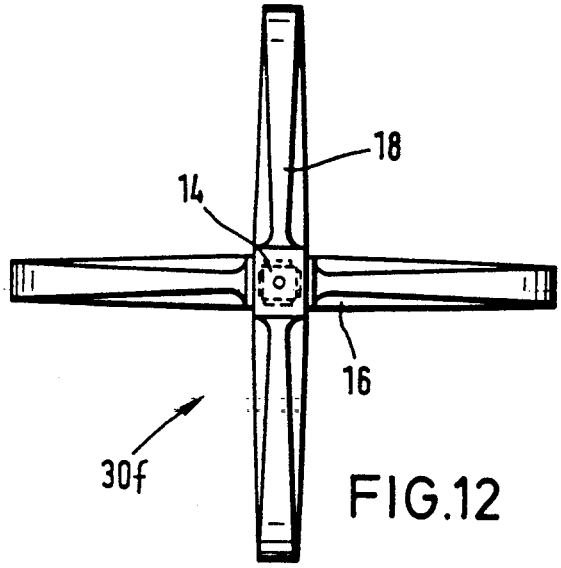
FIGS. 12 and 12*a* are, respectively, a bottom view and a side elevational view of two crossed stabilization bands according to a further embodiment of the invention.
Figure 12B:
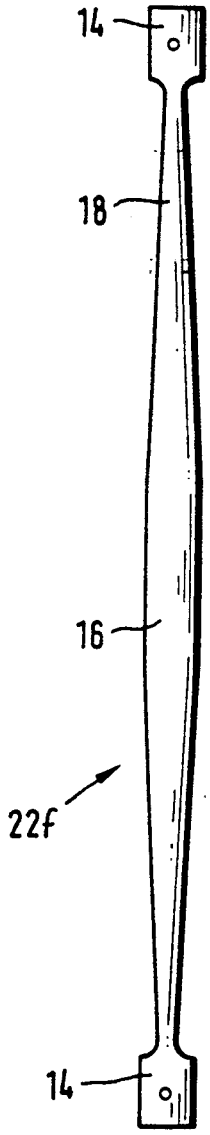
FIG. 12*b* is a stretched out plan view of a single stabilization band of the arrangement of FIGS. 12 and 12*a*.
Figure 12A:
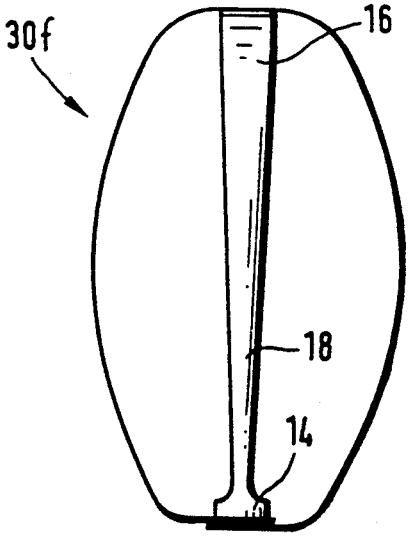

A similar configuration of band strips 22*f* with a continuously increasing width, but without the disc 56, is provided in the embodiment of the crossover stabilization band 30*f* of FIGS. 12, 12*a* and 12*b*.

It will be understood that the above description of the present invention is susceptible to various modifications, changes and adaptations, and the same are intended to be comprehended within the meaning and range of equivalents of the appended claims.

What is claimed is:

1. A bomblet projectile, comprising:
a projectile body having a rear end;
a fuse housing on the body at said rear end; and
unwindable stabilization band means for stabilizing the position of the projectile while dropping; the band means forming, in a deployed state, a loop having leg portions terminating in fastening regions secured to the fuse housing and a dome portion flanked by said leg portions; said band means having a length and different widths along the length; said band means being formed of at least one unwindable stabilization band each having a varying width along a length thereof; each band having a greatest width in said dome portion and a smallest width in said leg portions externally of said fastening regions.

2. A bomblet projectile as defined in claim 1, wherein the greatest width is about twice the narrowest width.

3. A bomblet projectile as defined in claim 1, wherein the greatest width is about three times the narrowest width.

4. A bomblet projectile as defined in claim 1, wherein the band means includes at least three individual stabilization bands, each being fixed to the fuse housing in the fastening regions and fixed to one another in the dome portion.

5. A bomblet projectile as defined in claim 1, further comprising a traction element attached to said band means at the fastening regions and at the dome portion and extending between the dome portion and the fastening regions; the traction element having a length slightly less than one half of a length of the loop.

6. A bomblet projectile as defined in claim 1, wherein the band means includes at least two stabilization bands crossing one another at a crossing zone in the dome portion; the bands being fixed to one another at the crossing zone; portions of the bands in the dome portion being longer on one side of the crossing zone than on the other side thereof.

7. A bomblet projectile as defined in claim 1, further comprising means, mounted on said band means in the dome portion, for further widening the band means in the dome portion.

8. A bomblet projectile as defined in claim 1, wherein the band means widens linearly from the fastening regions to the greatest width.

9. A bomblet projectile as defined in claim 1, wherein the stabilization means includes two stabilization bands, each forming an individual loop, the bands crossing over one another in their respective dome portions at a crossover zone; each band having fastening regions at opposite ends thereof fastened to the fuse housing.

10. A bomblet projectile as defined in claim 9, wherein the two stabilization bands are firmly affixed to one another in the crossover zone.

11. A bomblet projectile as defined in claim 1, wherein the stabilization band means includes means for causing the stabilization band means to assume an oblique position against an air stream component generated by rotation of the projectile and flowing essentially transversely to a longitudinal axis of the projectile.

12. A bomblet projectile as defined in claim 11, wherein the means for causing the stabilization band means to assume an oblique position comprises a tightly stitched seam along a longitudinal edge of the band means.

13. A bomblet projectile as defined in claim 12, wherein the longitudinal edge is a first longitudinal edge, and further wherein the means for causing the stabilization band means to assume an oblique position comprises a loosely stitched seam along a second longitudinal edge extending opposite said first longitudinal edge.

* * * * *